US010976095B2

(12) United States Patent
Lee et al.

(10) Patent No.: US 10,976,095 B2
(45) Date of Patent: Apr. 13, 2021

(54) REFRIGERATOR AND METHOD FOR CONTROLLING THE SAME

(71) Applicant: LG Electronics Inc., Seoul (KR)

(72) Inventors: Soonkyu Lee, Seoul (KR); Sungwook Kim, Seoul (KR); Kyongbae Park, Seoul (KR); Sangbok Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 82 days.

(21) Appl. No.: 15/964,387

(22) Filed: Apr. 27, 2018

(65) Prior Publication Data

US 2018/0313597 A1 Nov. 1, 2018

(30) Foreign Application Priority Data

Apr. 28, 2017 (KR) ..... 10-2017-0055025

(51) Int. Cl.
*F25D 21/00* (2006.01)
*F25D 17/06* (2006.01)
*F25D 21/08* (2006.01)

(52) U.S. Cl.
CPC ..... *F25D 21/004* (2013.01); *F25D 17/067* (2013.01); *F25D 21/002* (2013.01); (Continued)

(58) Field of Classification Search
CPC .... F25D 21/004; F25D 21/08; F25D 2600/02; F25D 2700/10; F24F 11/41
See application file for complete search history.

(56) References Cited

U.S. PATENT DOCUMENTS 5,415,005 A * 5/1995 Sterber ..... F25D 21/006 62/154
5,460,010 A * 10/1995 Kobayashi ..... F25D 17/045 62/187

(Continued)

FOREIGN PATENT DOCUMENTS

CN 104154696 11/2014
DE 102009028778 2/2011

(Continued)

OTHER PUBLICATIONS

European Search Report in European Application No. 18164635.7, dated Sep. 4, 2018, 9 pages.

(Continued)

*Primary Examiner* — Nelson J Nieves
(74) *Attorney, Agent, or Firm* — Fish & Richardson P.C.

(57) ABSTRACT

A method for controlling a refrigerator includes providing an initial input value to a heater configured to supply heat to an evaporator, performing a continuous operation of the heater based on the initial input value to increase a temperature of the evaporator to a predetermined temperature, determining a period of time taken to increase the temperature of the evaporator to the predetermined temperature, determining whether the period of time is within a reference period of time, operating the heater based on a first input value that is equal to the initial input value based on a determination that the period of time is outside of the reference period of time, and operating the heater based on a second input value that is less than the initial input value based on a determination that the period of time is within the reference period of time.

19 Claims, 11 Drawing Sheets

(52) U.S. Cl.
CPC ..... *F25D 21/08* (2013.01); *F25D 2321/1413* (2013.01); *F25D 2600/02* (2013.01); *F25D 2700/10* (2013.01)

(56) References Cited

U.S. PATENT DOCUMENTS

2002/0125859 A1* 9/2002 Takeo ..... B60H 1/00428 320/137
2003/0140639 A1* 7/2003 Gray ..... F25D 21/002 62/157
2011/0289949 A1* 12/2011 Bai ..... F25D 21/04 62/159
2012/0042667 A1* 2/2012 Fulmer ..... F25D 21/006 62/80
2012/0198863 A1* 8/2012 Hall ..... F25D 21/006 62/80
2013/0000336 A1* 1/2013 Hagiwara ..... F25D 31/005 62/159
2013/0081416 A1* 4/2013 Kim ..... F25D 21/02 62/151
2014/0033744 A1* 2/2014 Kim ..... F25D 21/002 62/80
2014/0053581 A1* 2/2014 Cho ..... F25D 21/008 62/80
2014/0123690 A1* 5/2014 Hanley ..... F25D 21/006 62/80
2014/0157800 A1* 6/2014 Kim ..... F25D 21/002 62/80
2015/0033773 A1* 2/2015 Tajima ..... F25D 17/045 62/80
2015/0047375 A1* 2/2015 Qu ..... F25D 21/004 62/80
2016/0123649 A1* 5/2016 Ahn ..... F25D 21/006 62/80
2017/0176084 A1* 6/2017 Iwamoto ..... F25D 17/062

FOREIGN PATENT DOCUMENTS

JP H06-34258 2/1994
JP H06-34259 2/1994
JP 2000-121233 4/2000
JP 5469993 4/2014

OTHER PUBLICATIONS

CN Office Action in Chinese Appln. No. 201810315223.5, dated Feb. 3, 2021, 22 pages (with English translation).

* cited by examiner

REFRIGERATOR AND METHOD FOR CONTROLLING THE SAME

CROSS-REFERENCE TO RELATED APPLICATIONS

This application claims the benefit of Korean Patent Application No. 10-2017-0055025, filed on Apr. 28, 2017, which is hereby incorporated by reference as if fully set forth herein.

FIELD

The present disclosure relates to a refrigerator and a method for controlling the same, and more particularly to a refrigerator, which has an improved defrosting reliability and energy efficiency, and a method for controlling the same.

BACKGROUND

A refrigerator may include a machine room located in a lower portion of a main body of the refrigerator. For example, a machine room in the lower portion of a refrigerator in order to lower the center of gravity of the refrigerator and to improve assembly efficiency, and to reduce vibration.

In some examples, a refrigerator may include a freezing cycle system in a machine room of the refrigerator in which an interior of the refrigerator may be maintained in a frozen or chilled state using a phenomenon in which low-pressure liquid refrigerant absorbs external heat through conversion into gaseous refrigerant to keep foods items fresh.

The freezing cycle system of the refrigerator may include a compressor for converting low-temperature and low-pressure gaseous refrigerant into high-temperature and high-pressure gaseous refrigerant, a condenser for converting the high-temperature and high-pressure gaseous refrigerant into high-temperature and high-pressure liquid refrigerant, and an evaporator for converting the low-temperature and high-pressure liquid refrigerant into a gas phase in order to absorb external heat. In some cases, the evaporator may be disposed in a separate space other than in the machine room, and may be located away from the other components of the freezing cycle system.

The evaporator may supply cool air to a storage compartment. As the evaporator exchanges heat with air inside of the storage compartment, frost may be formed on a surface of the evaporator over time. In order to remove the frost from the evaporator, a heater may be periodically operated, for instance. In some cases, a frequent operation of the heater may increase energy consumption. In some cases, the temperature in the storage compartment may be increased by heat generated from the heater, which may result in spoiling food in the storage compartment. In some cases, the compressor may further operate to lower the temperature increased by the heater, which may cause an increase in the amount of energy consumed by the compressor.

Therefore, there is an interest in a refrigerator that is capable of reliably removing frost from an evaporator and reducing energy consumption.

SUMMARY

The present disclosure is directed to a refrigerator and a method for controlling the same.

One object of the present disclosure is to provide a refrigerator, which has improved energy efficiency, and a method for controlling the same.

Another object of the present disclosure is to provide a refrigerator, which is capable of preventing the temperature of a storage compartment from rising sharply when a defrosting operation is performed on an evaporator, and a method for controlling the same.

A further object of the present disclosure is to provide a refrigerator, which is capable of improving defrosting reliability, and a method for controlling the same. According to the present disclosure, the probability of frost being removed from the evaporator may be increased.

Additional advantages, objects, and features of the disclosure will be set forth in part in the description that follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

According to one aspect of the subject matter described in this application, a method for controlling a refrigerator includes providing an initial input value to a heater of the refrigerator in which the heater is configured to supply heat to an evaporator of the refrigerator, performing a continuous operation of the heater based on the initial input value to increase a temperature of the evaporator to a predetermined temperature, determining a period of time taken to increase the temperature of the evaporator to the predetermined temperature, determining whether the period of time is within a reference period of time, operating the heater based on a first input value that is equal to the initial input value based on a determination that the period of time is outside of the reference period of time, and operating the heater based on a second input value that is less than the initial input value based on a determination that the period of time is within the reference period of time.

Implementations according to this aspect may include one or more of the following features. For example, performing the continuous operation of the heater may include performing the continuous operation of a plurality of heaters configured to supply heat to the evaporator. In some examples, operating the heater based on the first input value may include operating a plurality of heaters configured to supply heat to the evaporator based on the first input value. Operating the heater based on the second input value may include operating, based on a determination that the period of time is within the reference period of time, a first portion of a plurality of heaters configured to supply heat to the evaporator without operating a second portion of the plurality of heaters.

In some implementations, operating the heater based on the second input value may include operating the heater by decreasing the second input value over time. Operating the heater based on the second input value may include operating the heater by decreasing the second input value in proportion to time elapsed after starting operation of the heater based on the second input value. The second input value may include a first stage input value and a second stage input value that is less than the first stage input value in which operating the heater based on the second input value may include operating the heater based on the first stage input value, decreasing the second input value to the second stage input value, and operating the heater based on the second stage input value.

In some examples, the second input value may include a plurality of stage input values in which operating the heater based on the second input value further may include operating the heater based on the plurality of stage input values in which the plurality of stage input values decreases in a multi-stepwise manner over time. In some examples, the method may further include determining an amount of frost remaining on the evaporator. In some examples, the method may further include determining whether a condition for defrosting of the evaporator is satisfied in which performing the continuous operation of the heater may include performing the continuous operation of the heater based on a determination that the condition for defrosting of the evaporator is satisfied.

In some implementations, determining whether the period of time is within the reference period of time may include determining whether the period of time is within the reference period of time after starting performance of the continuous operation of the heater based on the initial input value. In some examples, the method may further include terminating a defrosting process of the evaporator that may include at least one of terminating operation of the heater based on the first input value or terminating operation of the heater based on the second input value. In some examples, performing the continuous operation of the heater based on the initial input value may include supplying constant input power to the heater for a first period of time.

According to another aspect of the subject matter, a refrigerator includes a storage compartment, an evaporator configured to supply cool air to the storage compartment, an evaporator temperature sensor configured to detect a temperature of the evaporator, a heater configured to supply heat to the evaporator, a timer configured to measure an elapse of time after the heater starts supply of heat to the evaporator, and a controller configured to control the heater. The controller is further configured to cause the heater to operate based on an initial input value to increase the temperature of the evaporator, determine, based on a measurement by the timer, a period of time taken to increase the temperature of the evaporator to a predetermined temperature, determine whether the period of time is within a reference period of time, operate the heater based on a first input value that is equal to the initial input value based on a determination that the period of time is outside of the reference period of time, and operate the heater based on a second input value that is less than the initial input value based on a determination that the time taken to reach the predetermined temperature is within the reference period of time.

Implementations according to this aspect may include one or more of the following features. For example, the refrigerator may further include a compressor that is configured to supply compressed refrigerant to the evaporator and that is configured to stop supply of compressed refrigerant to the evaporator based on operation of the heater. The controller may be further configured to, based on a determination that the period of time is within the reference period of time, decrease the second input value provided to the heater. In some examples, the second input value may include a first stage input value and a second stage input value that is less than the first stage input value in which the controller is further configured to, based on a determination that the period of time is within the reference period of time, operate the heater based on the first stage input value, decrease the second input value to the second stage input value, and operate the heater based on the second stage input value.

In some implementations, the refrigerator may further include a fan that is configured to blow cool air generated by the evaporator to the storage compartment and that is configured to, based on operation of the heater, stop blowing cool air to the storage compartment. In some examples, the heater may include a plurality of heaters that are disposed at different positions with respect to the evaporator. In some examples, the controller may be further configured to operate the heater based on a determination that a condition for defrosting the evaporator is satisfied.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate implementation(s) of the disclosure and together with the description serve to explain the principle of the disclosure.

DETAILED DESCRIPTION

Figure 1:
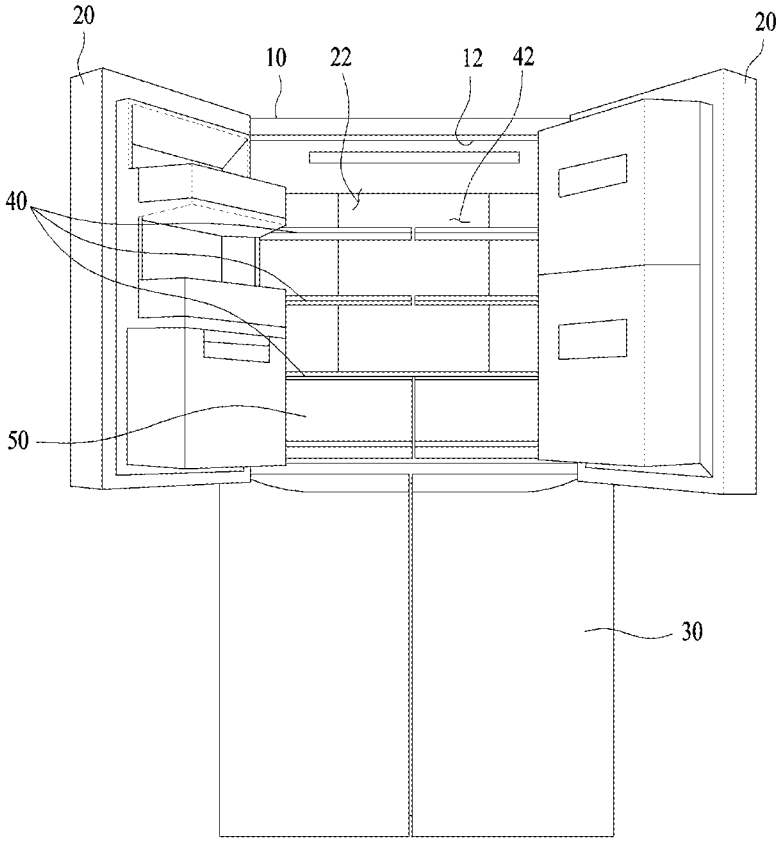
FIG. 1 is a front view showing an example refrigerator and example doors that are open.

A refrigerator is an appliance that may include a cabinet and a door that may be filled with a thermal insulation material to define a food storage compartment configured to block external heat, a freezing mechanism including an evaporator for absorbing internal heat of the food storage compartment, and a heat-dissipating device for discharging the collected heat outside of the food storage compartment. The refrigerator may maintain the food storage compartment in a low temperature range in which microorganisms are not able to survive or proliferate to keep stored food items fresh for a long time without spoilage.

The refrigerator may include a refrigerating compartment for storing foods in a temperature range above zero degrees Celsius and a freezing compartment for storing foods in a temperature range below zero degrees Celsius. Based on the arrangement of the refrigerating compartment and the freezing compartment, the refrigerator may be classified into a top-freezer-type refrigerator including a top freezing compartment and a bottom refrigerating compartment, a bottom-freezer-type refrigerator including a bottom freezing compartment and a top refrigerating compartment, and a side-by-side-type refrigerator including a left freezing compartment and a right refrigerating compartment.

In some examples, a plurality of shelves and drawers may be provided in the food storage compartment to allow a user to conveniently put food items in the food storage compartment or take out the food items stored therein.

Reference will now be made in detail to the preferred implementations of the present disclosure, examples of which are illustrated in the accompanying drawings.

In the drawings, the sizes and shapes of elements may be exaggerated for convenience and clarity of description. Also, the terms used in the following description are terms defined taking into consideration the configuration and the operation of the present disclosure. The definitions of these terms should be determined based on the entire content of this specification, because they may be changed in accordance with the intention of a user or operator or usual practices.

FIG. 1 is a front view of an example refrigerator in a state in which example doors thereof are open.

The refrigerator is applicable not only to a top-mount-type refrigerator, in which the storage compartment for storing food items is vertically partitioned such that a freezing compartment is disposed above a refrigerating compartment, but also to a side-by-side-type refrigerator, in which the storage compartment is laterally partitioned such that a freezing compartment and a refrigerating compartment are laterally arranged.

For convenience of explanation, the implementations will be described with reference to a bottom-freezer-type refrigerator, in which the storage compartment is vertically partitioned such that a freezing compartment is disposed under a refrigerating compartment.

The cabinet of the refrigerator includes an outer case 10 that defines the overall external appearance of the refrigerator seen by the user, and an inner case 12 that defines a storage compartment 22 for storing food items. A predetermined space may be defined between the outer case 10 and the inner case 12 to define a passage allowing cool air to circulate therethrough. In some examples, an insulation material may fill the space between the outer case 10 and the inner case 12 to maintain the interior of the storage compartment 22 at a low temperature relative to the exterior of the storage compartment 22.

In some implementations, a refrigerant cycle system configured to circulate refrigerant to produce cool air is installed in a machine room formed in the space between the outer case 10 and the inner case 12. The refrigerant cycle system may be used to maintain the interior of the refrigerator at a low temperature to maintain the freshness of the food items stored in the refrigerator. The refrigerant cycle system may include a compressor configured to compress refrigerant, and an evaporator configured to change the phase of refrigerant from the liquid state to the gaseous state so that refrigerant may exchange heat with the exterior. The evaporator is disposed in a separate chamber, rather than in the machine room.

The refrigerator may include doors 20 and 30 configured to open and close the storage compartment. The doors may include a freezing compartment door 30 and a refrigerating compartment door 20. For example, one end of each of the doors is pivotably installed to the cabinet of the refrigerator by hinges. In some examples, a plurality of freezing compartment doors 30 and a plurality of refrigerating compartment doors 20 may be provided. As shown in FIG. 1, the refrigerating compartment doors 20 and the freezing compartment doors 30 may be installed to be opened forwards by rotating about both edges of the refrigerator.

In some examples, the space between the outer case 10 and the inner case 12 may be filled with a foaming agent to thermally insulate the storage compartment 22 from the exterior.

The inner case 12 and the door 20 may define a space, which is thermally insulated from the exterior, in the storage compartment 22. When the storage compartment 22 is closed by the door 20, an isolated and thermally insulated space may be formed therein. For example, the storage compartment 22 is isolated from the external environment by the insulation wall of the door 20 and the insulation wall of the cases 10 and 12.

Cool air supplied from the machine room may flow everywhere in the storage compartment 22. Accordingly, the food items stored in the storage compartment 22 may be maintained at a low temperature.

The storage compartment 22 may include a shelf 40 on which food items are placed. The storage compartment 22 may include a plurality of shelves 40, and food items may be placed on each of the shelves 40. The shelves 40 may be positioned horizontally to partition the interior of the storage compartment.

A drawer 50 is installed in the storage compartment 22 such that the drawer 50 may be introduced into or withdrawn from the storage compartment 22. Various items including, but not limited to, food items may be accommodated and stored in the drawer 50. Two drawers 50 may be disposed side by side in the storage compartment 22. The user may open the left door of the storage compartment 22 to reach the drawer disposed on the left side. The user may open the right door of the storage compartment 22 to reach the drawer disposed on the right side.

The interior of the storage compartment 22 may be partitioned into a space positioned over the shelves 40 and a space formed by the drawer 50, whereby a plurality of partitioned spaces to store food items may be provided.

In some examples, cool air supplied to one storage compartment may not be allowed to freely move to another storage compartment, but may be allowed to freely move to the partitioned spaces formed in one storage compartment. For example, cool air located over the shelf 40 is allowed to move to the space formed by the drawer 50.

Figure 2A:
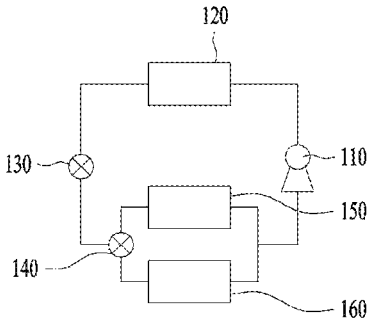
FIGS. 2A and 2B are views illustrating example freezing cycles.
Figure 2B:
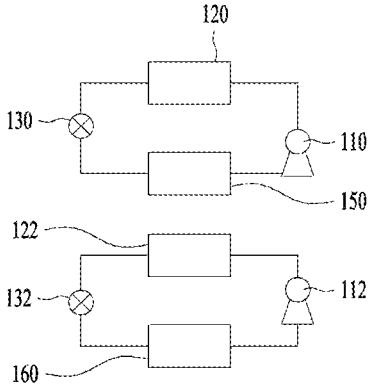

FIGS. 2A and 2B are views illustrating example freezing cycles.

As shown in FIG. 2A, the freezing cycle includes a compressor 110, a condenser 120, an expansion valve 130, and evaporators 150 and 160. The compressor 110 compresses refrigerant, the compressed refrigerant is cooled via heat exchange in the condenser 120, refrigerant is vaporized in the expansion valve 130, and refrigerant exchanges heat with the air in the evaporators 150 and 160. When the air cooled by the evaporators 150 and 160 is supplied to the storage compartment 22, the temperature of the storage compartment 22 may be lowered.

A valve 140 may determine whether refrigerant compressed in the compressor 110 is guided to the evaporator 150 or to the evaporator 160. The evaporator 150 may be a refrigerating compartment evaporator for supplying cool air to the refrigerating compartment, and the evaporator 160 may be a freezing compartment evaporator for supplying cool air to the freezing compartment.

When refrigerant compressed by the compressor 110 is supplied to the refrigerating compartment evaporator 150, cool air that has exchanged heat with the refrigerating compartment evaporator 150 may be supplied to the refrigerating compartment, and may cool the refrigerating compartment.

When refrigerant compressed by the compressor 110 is supplied to the freezing compartment evaporator 160, cool air that has exchanged heat with the freezing compartment evaporator 160 may be supplied to the freezing compartment, and may cool the freezing compartment.

In the implementation illustrated in FIG. 2A, refrigerant compressed by a single compressor 110 is selectively supplied to the refrigerating compartment evaporator 150 or to the freezing compartment evaporator 160, to thereby cool each evaporator and cool each storage compartment.

In the implementation illustrated in FIG. 2B, unlike the implementation in FIG. 2A, two compressors are provided. The compressor 110 supplies compressed refrigerant to the refrigerating compartment evaporator 150, and the compressor 112 supplies compressed refrigerant to the freezing compartment evaporator 160.

In some implementations, as shown in FIG. 2B, the freezing cycle system does not include a valve for switching the flow of refrigerant compressed by the compressors 110 and 112, but includes a condenser 120 and an expansion valve 130 to supply cool air to the refrigerating compartment and a condenser 122 and an expansion valve 132 to supply cool air to the freezing compartment.

In some implementations, as shown in FIG. 2B, the freezing cycle system may include two compressors 110 and 112 that are configured to cool the refrigerating compartment and the freezing compartment at the same time.

Figure 3:
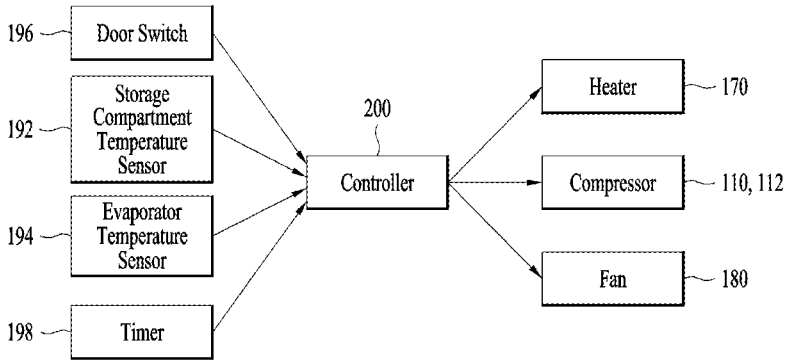
FIG. 3 is a block diagram showing an example controller and example components connected to the controller.

FIG. 3 is an example control block diagram showing an example controller and example components connected of the controller.

The implementation of the present disclosure includes a storage compartment temperature sensor 192 for measuring the temperature in the storage compartment. The storage compartment temperature sensor 192 may measure the temperature in the refrigerating compartment or the freezing compartment.

In addition, the implementation includes an evaporator temperature sensor 194 for measuring the temperature of the evaporator. The evaporator temperature sensor 194 is capable of measuring the temperature of the refrigerating compartment evaporator or the freezing compartment evaporator.

The temperature measured by the storage compartment temperature sensor 192 and the temperature measured by the evaporator temperature sensor 194 may be transmitted to the controller 200.

In addition, the implementation includes a door switch 196 to determine whether the door 20 or 30 is opened or closed. The door switch 196 may be provided at each of the doors in order to sense whether the freezing compartment door or the refrigerating compartment door is opened or closed.

In addition, the implementation includes a timer 198 for measuring an elapsed time. The time measured by the timer 198 may be transmitted to the controller 200 so that the controller 200 may perform control in accordance with the measured time.

The controller 200 may be configured to perform control in response to information transmitted from the storage compartment temperature sensor 192, the evaporator temperature sensor 194, the timer 198, and the door switch 196.

The implementation may include a heater 170 to remove frost from the freezing compartment evaporator 160 or the refrigerating compartment evaporator 150 by supplying heat to the freezing compartment evaporator 160 or the refrigerating compartment evaporator 150. One heater 170 may be provided only at the freezing compartment evaporator 160. Alternatively, respective heaters 170 may be provided at a corresponding one of the freezing compartment evaporator 160 and the refrigerating compartment evaporator 150. Alternatively, a plurality of heaters may be provided at each of the freezing compartment evaporator 160 and the refrigerating compartment evaporator 150.

The implementation may include compressors 110 and 112 for supplying compressed refrigerant to the refrigerating compartment evaporator or to the freezing compartment evaporator and a fan 180 for supplying cool air generated by the evaporators 150 and 160 to the storage compartment. The fan 180 may be provided at each of the freezing compartment evaporator 160 and the refrigerating compartment evaporator 150.

The controller 200 may control the compressors 110 and 112 and the refrigerating compartment fan 180 in response to the temperature measured by the evaporator temperature sensor 194 and the temperature measured by the refrigerating compartment temperature sensor 192.

Figure 4:
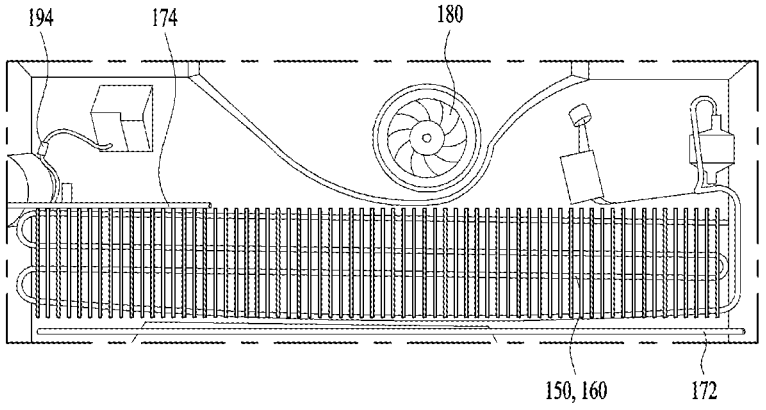
FIG. 4 is a view illustrating an example chamber including an example evaporator.

FIG. 4 is a view illustrating an example chamber configured to receive the evaporator.

The evaporator temperature sensor 194 may be installed in the chamber, in which the evaporator 150 or 160 is installed, in order to measure the temperature of the evaporator 150 or 160.

As shown in FIG. 4, the evaporator temperature sensor 194 may be installed in a pipe, which is located adjacent to the inlet of the evaporator 150 or 160, through which refrigerant is introduced into the evaporator.

The evaporator 150 or 160 may be implemented as an elongated pipe that is bent in a zigzag shape and is provided with a plurality of fins to increase a heat exchange area. The refrigerant that has passed through the expansion valve is supplied to the evaporator 150 or 160.

The evaporator temperature sensor 194 may be located upstream of a portion of the evaporator 150 or 160 at which the fins are formed, that is, may be located at a position at which refrigerant arrives before reaching the position at which the fins of the refrigerating compartment evaporator 150 are located.

The temperature of a portion adjacent to the inlet of the evaporator 150 or 160 is generally lower than that of other portions. The reason for this is that the evaporator 150 or 160 exchanges heat with external air as refrigerant is introduced into the evaporator 150 or 160 and that the portion corresponding to the inlet of the evaporator 150 or 160 does not vigorously exchange heat with external air.

The portion of the evaporator 150 or 160, the temperature of which is the lowest, may be a portion at which moisture is easily frozen and at which frost is consequently formed. Therefore, the evaporator temperature sensor 194 may be located at a portion of the evaporator 150 or 160, the temperature of which is relatively low, or at a portion at which frost is relatively easily formed, and may measure the temperature of the evaporator 150 or 160.

The heater 170, which supplies heat to the evaporator 150 or 160, may include a plurality of heaters 172 and 174. One of the heaters 170 may include a sheath heater, an L-cord heater, or the like.

For example, the heater 172 may be a sheath heater, and may be disposed under the evaporator 150 or 160. The heater 172 may be disposed so as to be spaced apart from the lower end of the evaporator 150 or 160. The air heated by the heater 172 may rise to the evaporator 150 or 160, and may supply heat to the evaporator 150 or 160 via convection.

The heater 174 may be an L-cord heater, and may be disposed in contact with the upper end of the evaporator 150 or 160 so that the heat emitted from the heater 174 is transferred to the evaporator 150 or 160 via conduction. Therefore, the evaporator 150 or 160 may be heated, and frost formed on the evaporator 150 or 160 may be melted and may fall down from the evaporator 150 or 160.

The heaters 172 and 174 are components that are independent from each other.

While one of the heaters is operated to emit heat, the other one thereof may not be operated. Needless to say, the two heaters may be operated to emit heat at the same time.

Figure 5:
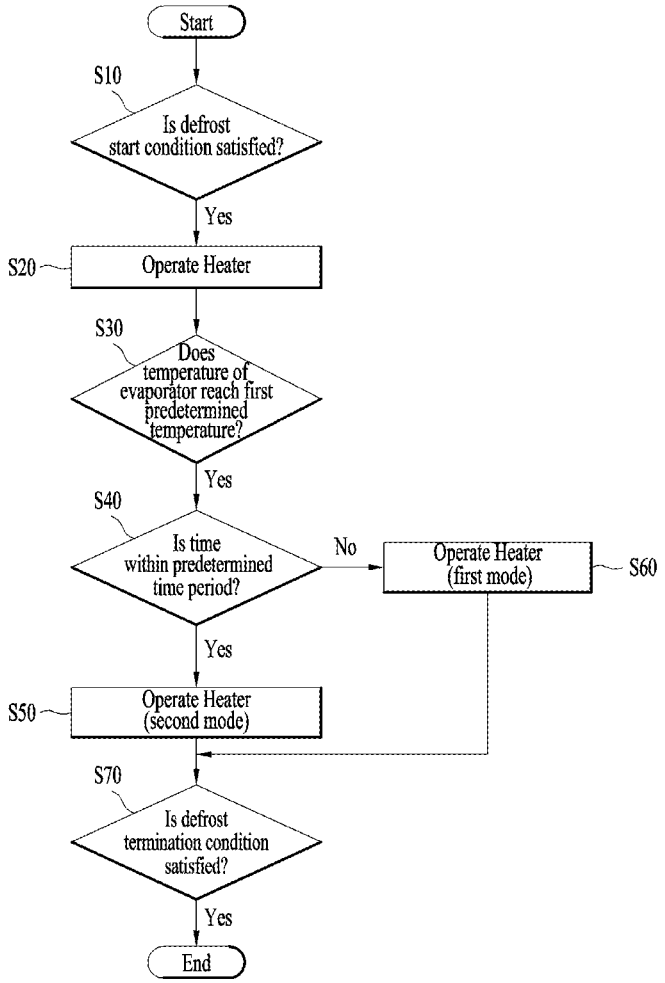
FIG. 5 is a flowchart showing an example process of defrosting the evaporator.

FIG. 5 is a flowchart showing an example process of defrosting the evaporator.

When the compressor 110 or 112 is operated, the compressed refrigerant may be moved to the evaporator 150 or 160. At this time, the fan 180 may be operated, and the air cooled by the evaporator may be moved to the storage compartment, whereby the storage compartment may be cooled.

As the operating time of the refrigerator elapses, frost may be formed on the surface of the evaporator 150 or 160.

It is determined whether a defrost start condition of the refrigerator is satisfied (S10).

The defrost start condition may be the time point at which a large amount of frost is formed on the evaporator 150 or 160 and thus the heat exchange efficiency of the evaporator is deteriorated.

When it is determined that the defrost start condition is satisfied, the heater 170 is operated (S20). Electric current may be supplied to the heater 170, and the heater 170 may generate heat.

The heat generated by the heater 170 may be transferred to the evaporator 150 or 160 via convection or conduction, and the evaporator 150 or 160 may be heated. Therefore, the frost formed on the evaporator 150 or 160 may start to melt.

The evaporator temperature sensor 194 may measure the temperature of the evaporator 150 or 160. While the heater 170 is operating, the temperature of the evaporator 150 or 160 may be measured simultaneously.

It is determined whether the temperature measured by the evaporator temperature sensor 194 reaches a first predetermined temperature (S30).

The first predetermined temperature may be variously set. Specifically, the first predetermined temperature may be set to about 5 degrees Celsius below zero degrees Celsius.

When the temperature of the evaporator 150 or 160 reaches the first predetermined temperature, it is determined whether the time taken to reach the first predetermined temperature is within a predetermined time period (S40).

The timer 198 may measure the time taken to reach the first predetermined temperature after the satisfaction of the defrost start condition and the resultant start of the operation of the heater 170, and may transmit related information to the controller 200.

If the temperature of the evaporator 150 or 160 reaches the first predetermined temperature within a predetermined time period, it may be predicted that only a relatively small amount of frost will remain on the evaporator 150 or 160. If the temperature of the evaporator 150 or 160 does not reach the first predetermined temperature within a predetermined time period, it may be predicted that a relatively large amount of frost will remain on the evaporator 150 or 160.

Although the heater 170 supplies a constant quantity of heat, the low rate of temperature increase indicates the situation in which a large amount of frost is present on the evaporator 150 or 160 and thus defrosting takes a lot of time. The high rate of temperature increase of the evaporator 150 or 160 indicates the situation in which a small amount of frost is present on the evaporator 150 or 160 and thus the frost can be easily removed using only a small quantity of heat from the heater.

Upon determining that the time taken to reach the first predetermined temperature is within a predetermined time period, the controller 200 operates the heater 170 in a second mode (S50).

Upon determining that the time taken to reach the first predetermined temperature is not within a predetermined time period, the controller 200 operates the heater 170 in a first mode (S60).

The first mode and the second mode may be set to operate the heater in different manners from each other, for example, different on/off duty ratios, different on/off cycles, and different input values, which are provided to the heater.

In other words, in the present disclosure, the heater is controlled to operate in different modes depending on the time taken to reach a specific temperature after the start of the defrost operation. Therefore, it is possible to prevent a rise in the temperature of the storage compartment attributable to excessive generation of heat from the heater or to prevent a waste of energy attributable to excessive supply of current to the heater.

In addition, in the present disclosure, in the case in which a large amount of frost remains on the evaporator and thus the thermal efficiency of the evaporator may be deteriorated, the heater may be controlled to generate a large quantity of heat so as to remove the remaining frost from the evaporator. Therefore, defrosting reliability with respect to the evaporator may be improved.

After the heater is operated in the first mode (S60) or in the second mode (S50), when a defrost termination condition is satisfied, the defrosting process may be terminated (S70).

Here, the defrost termination condition may be the situation in which the temperature of the evaporator 150 or 160 reaches a second predetermined temperature, which is higher than the first predetermined temperature. For example, the second predetermined temperature may be 1 degree Celsius above zero, which is higher than the first predetermined temperature. The second predetermined temperature may be variously set by a user, as long as it is higher than the first predetermined temperature.

In order to defrost the evaporator 150 or 160, the compressor 110 or 112 is stopped and is not operated while the heater 170 is operated.

In addition, while the heater 170 is operated, the fan 180 is not operated, but is maintained in a stationary state.

Therefore, the air heated by the heater 170 is prevented from being introduced into the storage compartment due to the fan 180.

Figure 6:
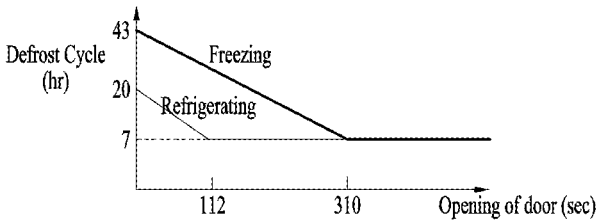
FIG. 6 is a view showing example time points at which a defrosting process is performed.

FIG. 6 is a view showing example time points at which the defrosting process is performed.

In some implementations, the time point at which the process of defrosting the freezing compartment evaporator is performed and the time point at which the process of defrosting the refrigerating compartment evaporator is performed may be set to be the same, or may be set independently of each other.

In some implementations, when the process of defrosting the freezing compartment evaporator is performed, the process of defrosting the refrigerating compartment evaporator may be performed simultaneously. Alternatively, the process of defrosting the freezing compartment evaporator may be started when the defrosting condition for the freezing compartment evaporator is satisfied, and the process of defrosting the refrigerating compartment evaporator may be started when the defrosting condition for the refrigerating compartment evaporator is satisfied. The defrosting condition for the freezing compartment evaporator and the defrosting condition for the refrigerating compartment evaporator may be different from each other, and it is therefore possible to perform the process of defrosting only one of the evaporators when a corresponding one of the defrosting conditions is satisfied.

Referring to FIG. 6, the condition under which the process of defrosting the freezing compartment evaporator is started may be a specific time point, for example, the time point at which the operating time of the freezing compartment is reduced from 43 hours to 7 hours. The maximum operating time of the freezing compartment may be set to 43 hours, and the operating time of the freezing compartment may decrease by 7 minutes every 1 second for which the freezing compartment door is opened. When the operating time of the freezing compartment is reduced to 7 hours, the process of defrosting the freezing compartment evaporator may be performed.

The defrosting process for the refrigerating compartment evaporator may be performed simultaneously when the above-described defrost start condition for the freezing compartment evaporator is satisfied. In this case, the defrost start condition for the refrigerating compartment evaporator may not be considered, and the defrosting process for the refrigerating compartment evaporator may be subordinate to the defrosting process for the freezing compartment evaporator. In this case, when the heater is operated to defrost the freezing compartment evaporator, the defrosting process for the refrigerating compartment evaporator may also be performed.

In some examples, the condition under which the process of defrosting the refrigerating compartment evaporator is started may be a specific time point, for example, the time point at which the operating time of the refrigerating compartment is reduced from 20 hours to 7 hours. The maximum operating time of the refrigerating compartment may be set to 20 hours, and the operating time of the refrigerating compartment may decrease by 7 minutes every 1 second for which the refrigerating compartment door is opened. When the operating time of the refrigerating compartment is reduced to 7 hours, the process of defrosting the refrigerating compartment evaporator may be performed.

Under these conditions, the defrosting process for the refrigerating compartment evaporator may be performed independently of the defrosting process for the freezing compartment evaporator. That is, the defrosting process for the freezing compartment evaporator may be performed when the defrosting condition for the freezing compartment evaporator is satisfied, and the defrosting process for the refrigerating compartment evaporator may be performed when the defrosting condition for the refrigerating compartment evaporator is satisfied.

For example, the defrosting process for the freezing compartment evaporator and the defrosting process for the refrigerating compartment evaporator may be performed independently of each other so as to defrost the respective evaporators. In this case, although the heater is operated to defrost the freezing compartment evaporator, if the defrosting condition for the refrigerating compartment evaporator is not satisfied, the defrosting process for the refrigerating compartment evaporator is not performed.

Figure 7:
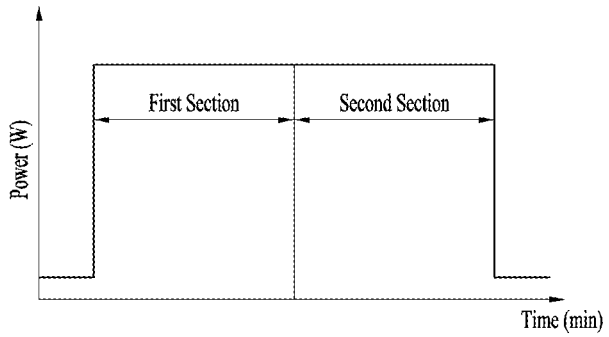
FIG. 7 is a view showing an example power profile for a heater control process.

FIG. 7 is a view showing an example power profile of an example heater control process.

The case in which the time taken for the temperature measured by the evaporator temperature sensor 194 to reach the first predetermined temperature exceeds the predetermined time period will be described with reference to FIG. 7.

That is, this case is the situation in which the amount of frost formed on the evaporator is large, and thus the rate of temperature increase of the evaporator is reduced and the predetermined time period expires in spite of the operation of the heater 170.

As shown in FIG. 7, the control of the heater 170 is divided into a first section and a second section.

When the control process goes from the first section to the second section, the control mode of the heater 170 may vary depending on whether the time taken for the temperature measured by the evaporator temperature sensor 194 to reach the first predetermined temperature exceeds the predetermined time period. In some cases, the control mode of the heater 170 may vary depending on whether the time taken for the temperature measured by the evaporator temperature sensor 194 to reach the first predetermined temperature is outside of the predetermined time period (e.g., over or under the predetermined time period).

In the implementation in FIG. 7, because the temperature of the evaporator 150 or 160 did not rise rapidly within the predetermined time period in spite of the operation of the heater 170, the heater is controlled in the second section in the same manner as in the first section.

For example, the heater 170 was continuously operated to heat the evaporator 150 or 160 in the first section, and is also continuously operated to heat the evaporator 150 or 160 in the second section.

That is, in the implementation in FIG. 7, the heater is operated in the first mode in the second section.

In the second section, the same input value as that in the first section is provided to the heater 170, whereby the heater 170 may heat the evaporator 150 or 160 while generating the same quantity of heat as that in the first section.

FIGS. 8 to 15B are views for explaining the situation in which the time taken for the temperature of the evaporator 150 or 160 to reach the first predetermined temperature does not exceed the predetermined time period, and thus the heater is operated in the first mode in the second section.

The implementations illustrated in FIGS. 8 to 15B are different from one another, and the respective implementations will be individually described below.

Figure 8:
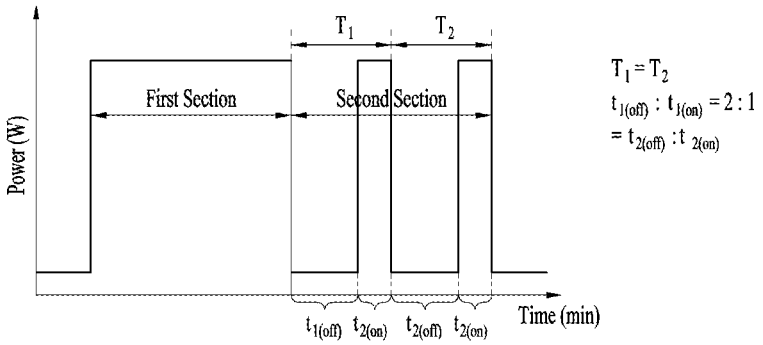
FIG. 8 is a view showing another example power profile for a heater control process.

FIG. 8 is a view showing an example power profile of an example heater control process.

As shown in FIG. 8, the controller 200 determines that the time taken to reach the first predetermined temperature is within the predetermined time period, and repeatedly turns the heater 170 on and off in the second section.

After the heater control process enters the second section, the time period during which the heater 170 is turned off for the first time is denoted by t1(off), and the time period during which the heater 170 is turned on again is denoted by t1(on).

The time period during which the heater 170 is turned off for the second time is denoted by t2(off), and the time period during which the heater 170 is turned on again is denoted by t2(on). Subsequently, the heater 170 may be further turned on and off for the third time or more. However, for convenience of description, the implementation will be described with reference to the process in which the on/off operation of the heater 170 is repeated twice.

In the implementation in FIG. 8, the period T, which is the sum of one on-time period and one off-time period of the heater 170, is maintained constant. The period T1 and the period T2 are expressed as follows: T1=t1(off)+t1(on), and T2=t2(off)+t2(on).

That is, the period T1 and the period T2 are expressed as follows: T1=T2=t1(off)+t1(on).

In the implementation in FIG. 8, the ratio of the off-time period to the on-time period of the heater 170 may be set to be constant.

For example, the aforementioned ratio may be expressed as follows: t1(off):t1(on)=t2(off):t2(on)=2:1.

When the heater control process enters the second section, the controller 200 may turn the heater 170 on and off such that the ratio of the off-time period to the on-time period in each cycle is maintained constant.

In the implementation in FIG. 8, when the heater control process enters the second section, a time period during which the heater 170 is turned off is present, and electric current is not supplied to the heater 170 during the off-time period. Therefore, the amount of current supplied to the heater 170 is reduced, and the amount of power consumed by the heater 170 is also reduced, thereby improving energy efficiency.

Even while the heater 170 is turned off, heat remains in the heater 170, and the interior of the chamber, in which the evaporator 150 or 160 is installed, is maintained in the heated state. Therefore, the evaporator 150 or 160 is also defrosted during the off-time period.

Accordingly, while the evaporator 150 or 160 is defrosted, the quantity of heat supplied from the heater 170 is reduced, thereby preventing the temperature in the storage compartment from rising sharply.

While the heater 170 is turned on and off repeatedly, when the defrost termination condition is satisfied, the heater 170 is not operated any longer, and the defrosting process for the evaporator 150 or 160 is terminated.

Figure 9:
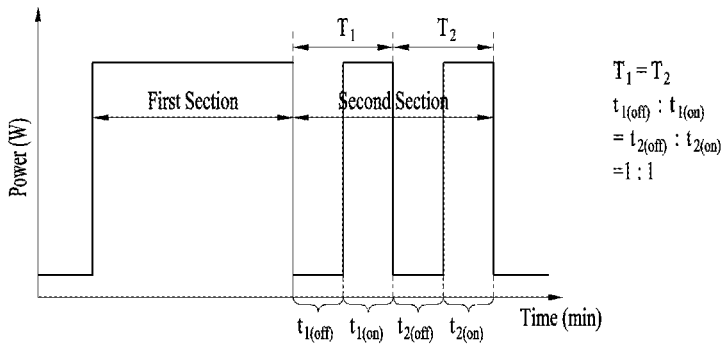
FIG. 9 is a view showing another example power profile for a heater control process.

FIG. 9 is a view showing an example power profile of an example heater control process.

Unlike the implementation in FIG. 8, the implementation in FIG. 9 performs the heater control process under the following conditions: t1(off):t1(on)=t2(off):t2(on)=1:1. In addition, the heater control process is performed under the following conditions: T1=T2=t1(off)+t1(on).

For example, after the heater control process enters the second section, the controller may perform the defrosting process for the evaporator 150 or 160 while maintaining the off-time period and the on-time period of the heater 170 in each cycle to be the same as each other.

In some implementations, since the ratio of the off-time period to the on-time period of the heater 170 is set to 1:1, only the elapsed time measured by the timer 198 is considered, without the necessity for consideration of the temperature measured by the evaporator temperature sensor 194. Therefore, the controller 200 may simply control the heater 170 using only the elapsed time.

According to an experiment of comparing the heater control process of the implementation in FIG. 9 with the heater control process (illustrated in FIG. 7) of continuously operating the heater without consideration of the remaining frost (without the determination on whether the time taken to reach the first predetermined temperature exceeds the predetermined time period), it can be verified that power consumption was reduced by 1.4 to 1.66%. In addition, according to the experiment results, the total time period taken to perform the defrost process was reduced by about 2.5 minutes, and the rate of temperature increase in the storage compartment was reduced. The temperature in the storage compartment rose by about 4.3 degrees Celsius in the process of continuously operating the heater without the determination on whether the time taken to reach the first predetermined temperature exceeds the predetermined time period. However, the temperature in the storage compartment rose by about 3.8 degrees Celsius in the process illustrated in FIG. 9. As a result, it can be verified that the rate of temperature increase in the storage compartment is reduced.

That is, if the operating mode of the heater is varied via the detection of the amount of remaining frost during the defrosting process in accordance with the implementation in FIG. 9, it can be verified that the defrosting time period is reduced and that the rate of temperature increase in the storage compartment is reduced. Therefore, the energy consumed for defrosting in the refrigerator may be saved, and spoilage of food attributable to a rise in the temperature in the storage compartment may be prevented.

Figure 10:
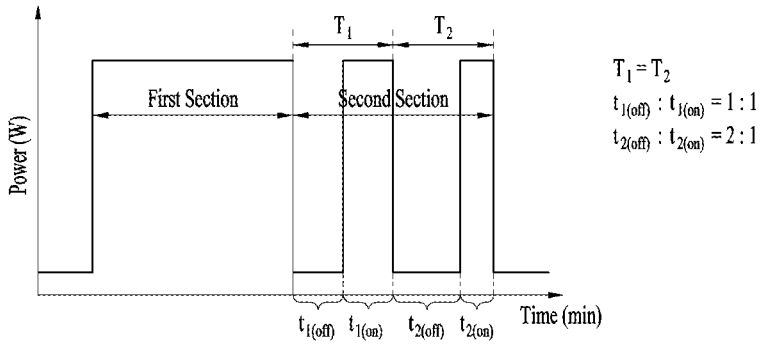
FIG. 10 is a view showing another example power profile for a heater control process.

FIG. 10 is a view showing an example power profile of an example heater control process.

The implementation, shown in FIG. 10, performs the heater control process under the following conditions: T1=T2, t1(off):t1(on)=1:1, and t2(off):t2(on)=2:1. That is, the ratio of the off-time period to the on-time period of the heater in one cycle is different from that in the other cycle.

As the time elapses, the off-time period of the heater 170 is increased so that the average quantity of heat per hour that is supplied from the heater 170 in the late stage of the defrosting process is decreased below that in the early stage of the defrosting process.

Therefore, in the state in which the ambient temperature around the evaporator 150 or 160 is sufficiently high, when the evaporator needs to exchange heat with the ambient air as time goes by, the heater 170 does not supply heat any longer, and thus energy efficiency may be improved. In addition, in the state in which the ambient temperature around the evaporator 150 or 160 is high, the rate of increase of the ambient temperature may be reduced, and thus exposure of the foods stored in the storage compartment to the high-temperature environment may be reduced.

Figure 11:
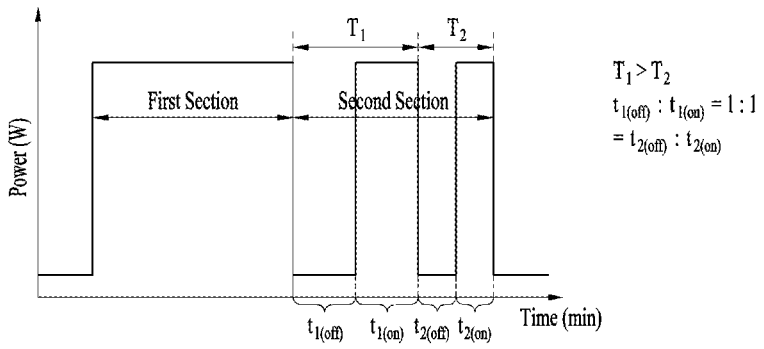
FIG. 11 is a view showing another example power profile for a heater control process.

FIG. 11 is a view showing an example power profile of an example heater control process.

The implementation in FIG. 11 performs the heater control process under the following conditions: T1>T2, and t1(off):t1(on)=t2(off):t2(on)=1:1.

In the implementation in FIG. 11, the on-time period and the off-time period of the heater 170 in the late stage of the defrosting process may be reduced to be shorter than those in the early stage of the defrosting process. That is, as the defrosting process is performed, the heater 170 is switched on and off rapidly, thereby making it possible to reduce the quantity of heat that is supplied from the heater 170 in the late stage of the defrosting process.

Therefore, it may be possible to prevent the ambient temperature around the evaporator 150 or 160 from rising sharply by controlling the heater 170 so that the temperature of the heater 170 does not rise and thus the quantity of heat supplied to the evaporator 150 or 160 is reduced.

Figure 12:
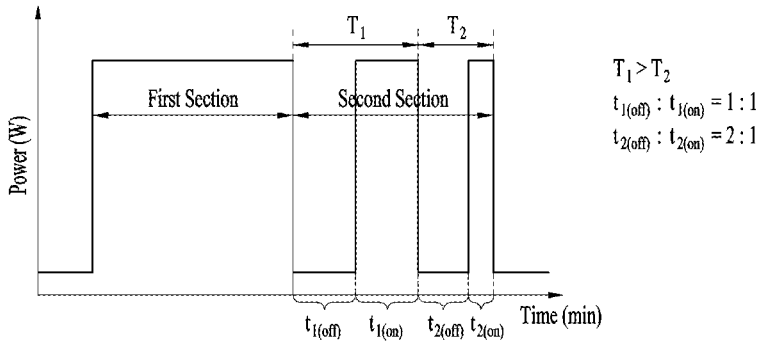
FIG. 12 is a view showing another example power profile for a heater control process.

FIG. 12 is a view showing an example power profile of an example heater control process.

The implementation in FIG. 12 performs the heater control process under the following conditions: T1>T2, t1(off):t1(on)=1:1, and t2(off):t2(on)=2:1.

In the implementation in FIG. 12, the on-time period and the off-time period of the heater 170 in the late stage of the defrosting process are reduced to be shorter than those in the early stage of the defrosting process, like the implementation in FIG. 11, and the ratio of the off-time period to the on-time period of the heater 170 is varied as the defrosting process is performed.

In the implementation in FIG. 12, since the on-time period of the heater 170 is reduced as time goes by while the defrosting process is performed, the amount of power consumed by the heater 170 is reduced in the late stage of the defrosting process, and thus energy efficiency may be improved.

Figure 13:
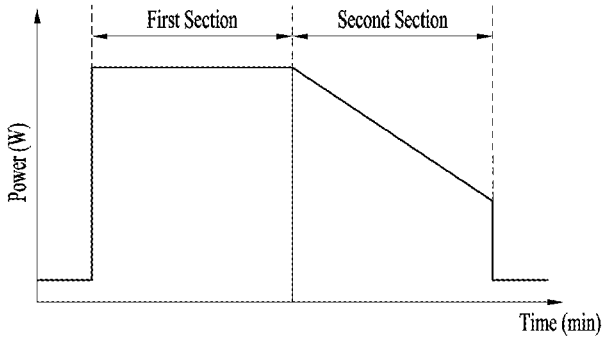
FIG. 13 is a view showing another example power profile for a heater control process.

FIG. 13 is a view for explaining a heater control process according to a further implementation.

In the implementation in FIG. 13, when it is determined that the time taken to reach the first predetermined temperature is within the predetermined time period, the input value that is provided to the heater 170 in the second section may be reduced to be smaller than that in the first section.

Because the input value that is provided to the heater 170 is continuously reduced in the second section, the quantity of heat that is supplied from the heater 170 in the second section may be reduced.

Since the evaporator 150 or 160 has received a sufficient amount of heat in the first section, even though heat is not additionally supplied to the evaporator in the second section, the frost formed on the evaporator 150 or 160 may be melted by the heat remaining in the heater 170 and the heat inside the chamber in which the evaporator 150 or 160 is installed.

Therefore, the quantity of heat that is supplied from the heater 170 is gradually decreased in the second section, thereby preventing the temperature in the storage compartment from rising sharply due to the introduction of hot air into the storage compartment.

Here, since the input value that is provided to the heater 170 is linearly reduced in the second section, the quantity of heat that is emitted from the heater 170 may also be linearly reduced. That is, the input value that is provided to the heater 170 may be reduced in proportion to the elapsed time.

The vertical axis in FIG. 13 may denote power or current supplied to the heater 170. However, the vertical axis in FIG. 13 may denote the quantity of heat emitted from the heater 170.

The second section includes a region in which the input value provided to the heater 170 is smaller than that in the first section. Therefore, the heater 170 generates a smaller amount of heat per hour in the second section than in the first section.

When the defrost termination condition is satisfied, that is, when the temperature measured by the evaporator temperature sensor 194 reaches the second predetermined temperature, the defrosting process for the evaporator 150 or 160 is terminated. At this time, electric current is not supplied to the heater 170, and the heater 170 does not generate heat any longer. As a result, the defrosting process may be terminated.

The inclination at which the input value provided to the heater 170 is decreased may be variously changed. For example, the input value may be decreased sharply or gently over time. In the case in which the input value is decreased gently, as shown in FIG. 13, the heater 170 may be controlled such that the defrosting process is terminated before the input value provided to the heater 170 reaches 0.

Figure 14:
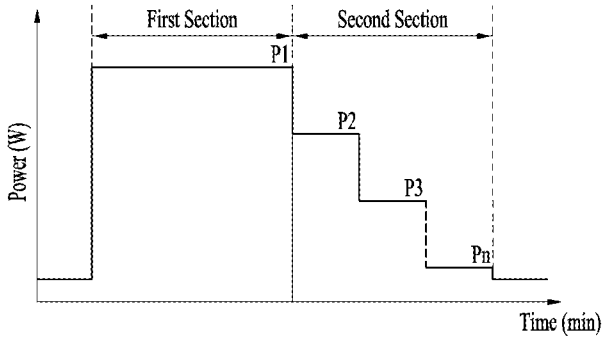
FIG. 14 is a view showing another example power profile for a heater control process.

FIG. 14 is a view showing an example power profile of an example heater control process.

In the implementation in FIG. 14, when it is determined that the time taken to reach the first predetermined temperature is within the predetermined time period, the input value that is provided to the heater 170 in the second section may be reduced to be smaller than that in the first section.

On the assumption that the input value provided to the heater 170 in the first section is P1, input values P2, P3, . . . , and Pn, which are smaller than the input value P1, may be provided to the heater 170 in the second section.

The input values P2, P3, . . . , and Pn, which are provided to the heater 170 in the second section, may be decreased in a discontinuous manner, for example, in a stepwise manner, rather than in a continuous manner.

That is, the input values, which are decreased over time, are provided to the heater 170 in stages in the second section.

The reduction ratios between the input values P2, P3, . . . , and Pn may be the same as each other, or may be different from each other. In the case in which the reduction ratios between the input values are different from each other, the reduction ratios may be set to be decreased over time in the second section. Unlike this, the input values P2, P3, . . . , and Pn may be set to be reduced regularly in that order.

Because the input values, which are reduced over time, are provided to the heater 170 in the second section, the quantity of heat that is supplied from the heater 170 is decreased over time. In the state in which the temperature of the evaporator 150 or 160 is sufficiently high, the rate of temperature increase of the evaporator 150 or 160 may be reduced, thereby preventing the temperature in the storage compartment from rising sharply.

Because the constant input value P1 is continuously provided to the heater in the first section, a large amount of heat may be transferred to the evaporator 150 or 160 in a short time in the early stage of the process of defrosting the evaporator 150 or 160. Because a relatively small amount of heat is transferred to the evaporator 150 or 160 for a long time in the second section, the evaporator 150 or 160 may provide enough time to melt the frost via heat exchange with the ambient air in the chamber.

When it is determined that the temperature of the evaporator, which is measured by the evaporator temperature sensor 194, does not reach the first predetermined temperature within the predetermined time period, the input value, which has the same magnitude as the input value P1 in the first section, is provided to the heater 170 in the second section. In this case, it is determined that a large amount of frost remains on the evaporator 150 or 160 in spite of the defrosting process performed in the first section, and thus the quantity of heat that is supplied from the heater 170 to the evaporator 150 or 160 may not be reduced.

In the implementation in FIG. 14, when the defrost termination condition is satisfied, that is, when the temperature measured by the evaporator temperature sensor 194 reaches the second predetermined temperature, the supply of current to the heater 170 may be stopped.

FIG. 15 is a view showing an example power profile of an example heater control process.

The heater 170 may include a plurality of heaters 172 and 174, and the respective heaters may be individually controlled.

Figure 15A:
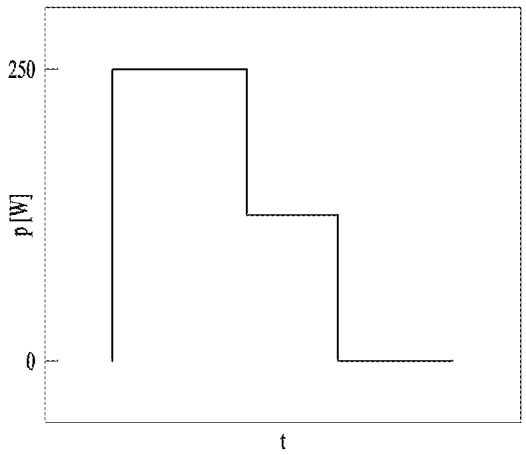
FIGS. 15A and 15B are views showing example power profiles for a heater control process.

In the case of a sheath heater, as shown in FIG. 15A, the input value may be applied to the heater in three stages over time. In the case of an L-cord heater, as shown in FIG. 15B, the input value may be applied to the heater in two stages.

Figure 15B:
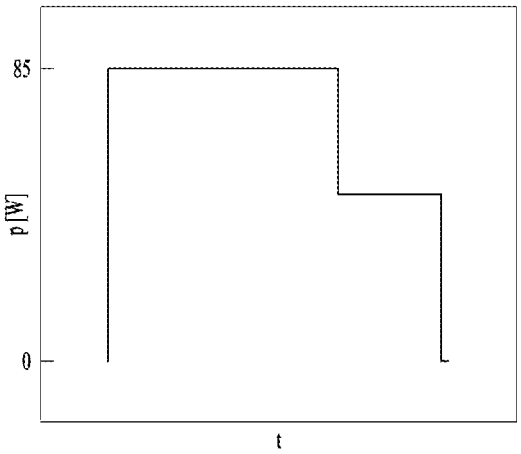

If the control process in FIG. 15A and the control process in FIG. 15B are combined, control may be performed such that input values are reduced in stages using a plurality of heaters.

For example, a plurality of heaters (e.g., the sheath heater and the L-cord heater) may all be operated in the first section, and only one of the sheath heater and the L-cord heater may be operated in the second section.

In some implementations, a plurality of heaters (e.g., the sheath heater and the L-cord heater) may all be operated in the first section, and the sheath heater and the L-cord heater may be operated using the input values, each of which is reduced in stages, in the second section.

Because the total quantity of heat, which is supplied from the plurality of heaters, is reduced overall in the second section, the quantity of heat that is supplied to the evaporator 150 or 160 may be reduced, and the rate of temperature increase of the evaporator may be reduced.

Figure 16:
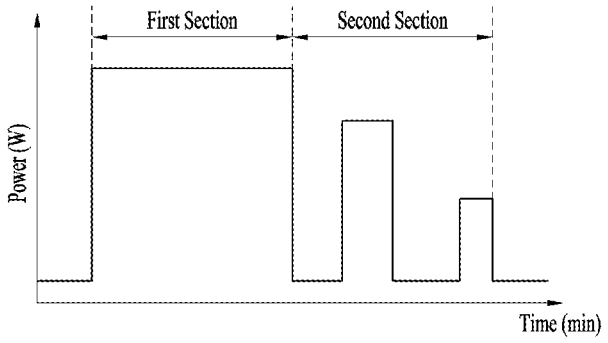
FIG. 16 is a view showing another example power profile for a heater control process.

FIG. 16 is a view showing another example power profile of an example heater control process.

The implementation in FIG. 16 is a combination of the implementations in FIGS. 8 to 12 and the implementations in FIGS. 13 to 15B.

For example, when the defrosting process is performed by supplying heat from the heater to the evaporator 150 or 160, if the temperature of the evaporator 150 or 160 rises to the first predetermined temperature within the predetermined time period, the heater 170 may be turned on and off in the second section, and the input value, which is provided to the heater 170, may be reduced during the on-time period of the heater 170.

Because the implementation in FIG. 16 is the same as the above-described implementations, a detailed description thereof will be omitted.

As is apparent from the above description, according to the present disclosure, the amount of remaining frost is estimated while the evaporator is defrosted, whereby a relatively large amount of heat is applied from the heater to the evaporator when a relatively large amount of frost remains, and a relatively small amount of heat is applied from the heater to the evaporator when a relatively small amount of frost remains. Therefore, it is possible to prevent the heater from generating excessive heat in consideration of the amount of remaining frost and to reduce power consumption of the refrigerator.

In addition, since the supplied amount of heat varies depending on the amount of remaining frost, the likelihood of frost remaining on the evaporator is reduced, thereby improving defrosting reliability.

In addition, since the quantity of heat that is supplied to the evaporator can be reduced, it is possible to prevent the temperature in the storage compartment from rising sharply and consequently to prevent spoilage of foods stored in the storage compartment.

It will be apparent to those skilled in the art that various modifications and variations can be made in the present disclosure without departing from the spirit or scope of the disclosure. Thus, it is intended that the present disclosure covers the modifications and variations of this disclosure provided they come within the scope of the appended claims and their equivalents.

What is claimed is:

1. A method for controlling a refrigerator, the method comprising:

providing an initial input value to a heater of the refrigerator, the heater being configured to supply heat to an evaporator of the refrigerator;

performing a continuous operation of the heater based on the initial input value to increase a temperature of the evaporator to a predetermined temperature;

determining a period of time taken to increase the temperature of the evaporator to the predetermined temperature;

determining whether the period of time is within a reference period of time;

based on a determination that the period of time is outside of the reference period of time, operating the heater based on a first input value that is equal to the initial input value; and based on a determination that the period of time is within the reference period of time, operating the heater based on a second input value that is less than the initial input value, wherein operating the heater based on the second input value comprises operating, based on a determination that the period of time is within the reference period of time, a first portion of a plurality of heaters configured to supply heat to the evaporator without operating a second portion of the plurality of heaters, the first portion of the plurality of heaters including the heater.

2. The method according to claim 1, wherein performing the continuous operation of the heater comprises performing continuous operations of a plurality of heaters configured to supply heat to the evaporator, the plurality of heaters including the heater.

3. The method according to claim 1, wherein operating the heater based on the first input value comprises operating a plurality of heaters configured to supply heat to the evaporator based on the first input value, the plurality of heaters including the heater.

4. The method according to claim 1, wherein operating the heater based on the second input value comprises operating the heater by decreasing the second input value over time.

5. The method according to claim 1, wherein operating the heater based on the second input value comprises operating the heater by decreasing the second input value in proportion to time elapsed after starting operation of the heater based on the second input value.

6. The method according to claim 1, wherein the second input value comprises a first stage input value and a second stage input value that is less than the first stage input value, and wherein operating the heater based on the second input value comprises:

operating the heater based on the first stage input value, decreasing the second input value to the second stage input value, and operating the heater based on the second stage input value.

7. The method according to claim 6, wherein the second input value comprises a plurality of stage input values, and wherein operating the heater based on the second input value further comprises operating the heater based on the plurality of stage input values, the plurality of stage input values decreasing in a multi-stepwise manner over time.

8. The method according to claim 1, further comprising determining an amount of frost remaining on the evaporator.

9. The method according to claim 1, further comprising determining whether a condition for defrosting of the evaporator is satisfied, wherein performing the continuous operation of the heater comprises performing the continuous operation of the heater based on a determination that the condition for defrosting of the evaporator is satisfied.

10. The method according to claim 1, wherein determining whether the period of time is within the reference period of time comprises determining whether the period of time is within the reference period of time after starting performance of the continuous operation of the heater based on the initial input value.

11. The method according to claim 1, further comprising terminating a defrosting process of the evaporator that comprises at least one of terminating operation of the heater based on the first input value or terminating operation of the heater based on the second input value.

12. The method according to claim 1, wherein performing the continuous operation of the heater based on the initial input value comprises supplying constant input power to the heater for a first period of time.

13. A refrigerator comprising:

a storage compartment;

an evaporator configured to supply cool air to the storage compartment;

an evaporator temperature sensor configured to detect a temperature of the evaporator;

a heater configured to supply heat to the evaporator;

a timer configured to measure an elapse of time after the heater starts supply of heat to the evaporator; and a controller configured to control the heater, wherein the controller is further configured to:

cause the heater to operate based on an initial input value to increase the temperature of the evaporator, determine, based on a measurement by the timer, a period of time taken to increase the temperature of the evaporator to a predetermined temperature, determine whether the period of time is within a reference period of time, based on a determination that the period of time is outside of the reference period of time, operate the heater based on a first input value that is equal to the initial input value, based on a determination that the period of time taken to reach the predetermined temperature is within the reference period of time, operate the heater based on a second input value that is less than the initial input value, and based on the determination that the period of time is within the reference period of time, operate a first portion of a plurality of heaters configured to supply heat to the evaporator without operating a second portion of the plurality of heaters, the first portion of the plurality of heaters including the heater.

14. The refrigerator according to claim 13, further comprising a compressor that is configured to supply compressed refrigerant to the evaporator and that is configured to stop supply of compressed refrigerant to the evaporator based on operation of the heater.

15. The refrigerator according to claim 13, wherein the controller is further configured to, based on a determination that the period of time is within the reference period of time, decrease the second input value provided to the heater.

16. The refrigerator according to claim 13, wherein the second input value comprises a first stage input value and a second stage input value that is less than the first stage input value, and wherein the controller is further configured to, based on a determination that the period of time is within the reference period of time:

operate the heater based on the first stage input value, decrease the second input value to the second stage input value, and operate the heater based on the second stage input value.

17. The refrigerator according to claim 13, further comprising a fan that is configured to blow cool air generated by the evaporator to the storage compartment and that is configured to, based on operation of the heater, stop blowing cool air to the storage compartment.

18. The refrigerator according to claim 13, wherein the heater is one of a plurality of heaters that are disposed at different positions with respect to the evaporator.

19. The refrigerator according to claim 13, wherein the controller is further configured to operate the heater based on a determination that a condition for defrosting the evaporator is satisfied.

* * * * *